US006499008B2

(12) United States Patent
Miet

(10) Patent No.: US 6,499,008 B2
(45) **Date of Patent: *Dec. 24, 2002**

(54) TRANSCEIVER FOR SELECTING A SOURCE CODER BASED ON SIGNAL DISTORTION ESTIMATE

(75) Inventor: Gilles Miet, Le Mans (FR)

(73) Assignee: Koninklijke Philips Electronics N.V., Eindhoven (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/316,776

(22) Filed: May 21, 1999

(65) Prior Publication Data

US 2002/0069075 A1 Jun. 6, 2002

(30) Foreign Application Priority Data

May 26, 1998 (FR) ..... 98 06616

(51) Int. Cl.[7] ..... G10L 19/14; G10L 19/00
(52) U.S. Cl. ..... 704/200.1; 704/220; 704/221
(58) Field of Search ..... 704/200.1, 219, 704/220, 221

(56) References Cited

U.S. PATENT DOCUMENTS

| | | | | | |
|---|---|---|---|---|---|
| 5,457,783 | A | * | 10/1995 | Chhatwal | 704/219 |
| 5,799,272 | A | | 8/1998 | Zhu | 704/223 |
| 5,802,487 | A | * | 9/1998 | Tanaka | 704/230 |
| 5,878,387 | A | * | 3/1999 | Oshikiri et al. | 704/207 |
| 6,169,970 | B1 | * | 1/2001 | Kleijn | 704/219 |
| 6,418,147 | B1 | * | 7/2002 | Wiedeman | 370/468 |

FOREIGN PATENT DOCUMENTS

| | | | |
|---|---|---|---|
| EP | 0417739 A2 | 3/1991 | H04L/1/20 |
| JP | 08237711 A | 9/1996 | H04Q/7/14 |

* cited by examiner

*Primary Examiner*—Tālivaldis Ivars Šmits
(74) *Attorney, Agent, or Firm*—Gwenaella Le Pennec

(57) ABSTRACT

A radio signal transceiver receiving at its input a speech signal and producing an output signal at a given output rate, the speech signal having undergone a source coding intended to sufficiently compress the input signal to obtain the desired output rate while an acceptable distortion ratio is maintained. In order to improve the compromise of transmission quality of the speech signal and transmission rate by selecting the optimum coder from the available coders, the transceiver comprises a measuring device for measuring the distortion of the output signal of a coder and a check circuit for comparing the estimated distortion with set values and deriving therefrom the optimum coder for the measured distortion.

15 Claims, 2 Drawing Sheets

TRANSCEIVER FOR SELECTING A SOURCE CODER BASED ON SIGNAL DISTORTION ESTIMATE

FIELD OF THE INVENTION

This invention relates to a digital signal transceiver comprising a transmitting part and a receiving part, the transmitting part receiving at its input a speech signal called original signal, and including:

source coder means including a plurality of source coders for compressing said speech signal and delivering a compressed signal at a given output rate, said compressed signal having a measurable distortion and means for selecting a source coder from the plurality of coders.

The invention also relates to telephony equipment and a digital telecommunications system.

The invention likewise relates to a digital signal transmission process, comprising the following steps:

a receiving step of receiving a speech signal called original signal, a source coding step of compressing said speech signal and delivering a compressed signal at a given output rate, said compressed signal having a measurable distortion, and a selection step of selecting a source coder from a plurality of coders for realizing the source coding step.

The invention finally relates to a digital signal reception process, comprising a source-decoding step.

The invention is notably applied to any cellular terminal operating according to a digital telecommunications standard of the GSM type (Global System for Mobile communications), PCS1900 (Personal Communications System), PHS (Personal Handyphone System), TDMA (Time-Division Multiple Access), CDMA (Code-Division Multiple Access), WBCDMA (WideBand CDMA), UMTS (Universal Mobile Telecommunications System) etc.

BACKGROUND OF THE INVENTION

Japanese abstract published under no. 08237711 A describes a transceiver of the type defined in the opening paragraph, for enhancing the quality of an audio signal to be transmitted. For this purpose, the transceiver comprises means for directly testing in the useful signal the performance of families of source coders successively selected from a list of available families and means for comparing each output signal with the original signal so as to transmit only the coded signal that comes nearest to the original signal.

SUMMARY OF THE INVENTION

The invention proposes a less expensive method for optimizing the compromise between transmission quality of the speech signal and capacity of the communication means in digital telecommunications devices that involve a source coding.

For this purpose, a device of the type defined in the opening paragraph is provided, characterized in that said selection means comprise:

calculation means for forming an estimate of the distortion of the compressed signal, check means for comparing this estimate with set values and selecting a source coder in dependence on the result of this comparison.

Thus, each original signal undergoes only one source-coding test before the optimum coder is selected, while the same coder family is adhered to.

According to an important characteristic feature of the invention, the receiving part comprises a plurality of decoders compatible with said source coders and control means co-operating with said check means for automatically selecting from the plurality of decoders a decoder that is compatible with the source coder selected by said check means.

According to a particular embodiment of the invention, the source coder delivers an internal residual error signal and said calculation means use said error signal for estimating said distortion.

According to another embodiment, the calculation means comprise:

inverse source decoder means co-operating with the source coder means for producing a decoded signal based on said compressed signal, means for comparing the decoded signal with the original signal to produce a residual error signal and means for processing the residual error signal to derive said estimate therefrom.

A transmission process of the type defined in the opening paragraph is provided, characterized in that said selection step comprises:

a calculation sub-step for forming an estimate of the distortion of the compressed signal, a check sub-step for comparing this estimate with set values and selecting a source coder as a function of the result of said comparison.

The invention finally provides a reception process of the type defined in the opening paragraph for decoding a compressed signal via a transmission process of the above type, characterized in that the reception process comprises a step of automatically selecting a decoder from a plurality of available decoders as a function of said selected source coder.

BRIEF DESCRIPTION OF THE DRAWINGS

These and other aspects of the invention are apparent and will be elucidated, by way of non-limitative example, with reference to the embodiments described hereinafter.

In the drawings.

DESCRIPTION OF THE EMBODIMENTS

Figure 1:
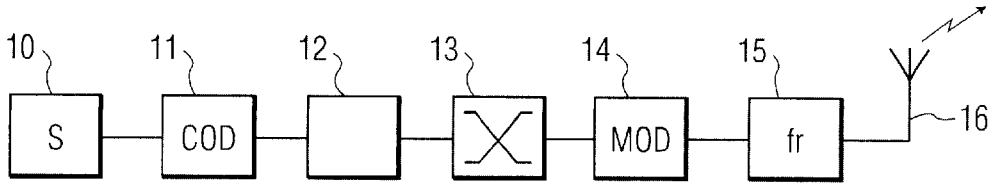
FIG. 1 PRIOR ART
FIG. 1 is a block diagram of a conventional digital transmitter.

The general structure of a digital transmitter for a GSM system, that is, without extending the spectrum, is given in FIG. 1. It comprises a source 10, a source coder 11 (COD), a channel coder 12, a multiplexer 13, a modulator 14 (MOD), a device 15 for transposing the signal to a radio frequency rf and an antenna 16.

The signal S transmitted by the source 10 is either analog, such as, for example, speech, and is thus to be digitized, or is directly digital just like the signaling signals. An interest is taken here in the speech signal whose transmit quality is to be improved. This signal undergoes a coding, called source coding, performed by the source coder 11 to minimize the quantity of data to be transmitted.

There are many source coding methods such as pulse code modulation (PCM) or synthesis analysis coding. The first method performs a sampling at 8 kHz (a little more than twice the highest frequency present according to the Nyquist criterion) of the band called <<telephone band>> lying between 300 and 3400 Hz. Each sample is coded into eight bits. A rate of 8*8=64 kbits is obtained. The second method actually used in the GSM standard uses a model of producing speech with the aid of a LPC analysis (Linear Predictive Coding) of the speech signal. By utilizing this type of coder and these variants, rates are obtained that are well below those obtained by means of a PCM coding, such as, for example, 13 kbits/s for the full-rate GSM coder.

The signal thus coded is processed by a second coder 12 called channel coder, whose object is to add redundancy to the symbol sequence to be transmitted, so as to diminish the risks of transmission errors. The multiplexer 13 then shapes and multiplexes the coded data between the various available logic channels in dependence on the type of multiple access used for the transmission. For example, for a time-division multiplex system, a physical channel occupies only a limited time slot. The blocks of coded data are thus to be subdivided into sub-blocks to be inserted into the time intervals on the radio channel.

Once the multiplexing has been realized, the modulator 14 modulates the symbol sequence. This operation consists of transforming the digital symbol sequence into a signal to be transmitted by the channel. The signal is then transformed into a waveform corresponding to the selected type of modulation. The modulation causes an overflow to occur in the neighboring channels that need to be filtered. The suitable device 15 subsequently transposes the signal to the radio frequency rf, that is to say, to the carrier frequency of the channel before the signal is transmitted by radio waves via the antenna 16.

As the receiver also has a generally conventional shape, a person of skill in the art will easily derive its structure from that of the transmitter that has just been described.

Figure 2:
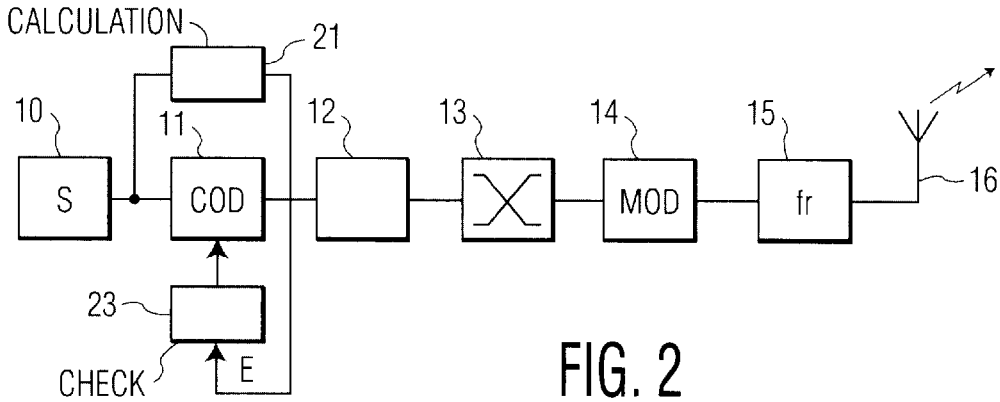
FIG. 2 is a block diagram of the transmitting part of a transceiver according to the invention.

A transmission device according to the invention is illustrated in FIG. 2. Like blocks occurring in FIG. 1 carry like references. A calculation block 21 and a check block 23 have been added to the conventional transmission chain. The calculation block 21 comprises measuring means for making an estimate of the distortion of the output signal of the source coder 11. The source coder block 11 comprises various coders that may be selected by the check block 23. For this purpose, the check block 23 compares the estimate of the distortion to threshold values stored in a table in the memory of the device and selects a source coder from the coders available in the source coder block 11 in dependance on the outcome of the comparison. If the measured distortion is within predetermined acceptable values, the same (current) coder will be used again. Otherwise, a different coder of the plurality of coders in source coder block 11 will be selected based on the measured distortion with respect to the stored threshold values in the memory.

The various coders may be referenced, for example, in an increasing order of precision, that is to say, in an increasing order of output rate. In this case, when a high reference threshold (low, respectively) is reached for the estimate of the distortion, the check block automatically selects the available coder that is a trifle better (worse, respectively) in terms of precision.

The check block 23 is then to make a request to the network to change coders and is to wait for its consent before effectively selecting the new, better adapted coder. In case the network refuses, the previous coder is retained. In effect, it is necessary for the two communicating parties, here the radiotelephone and the network, to use compatible coders and decoders.

Certain networks transmit digital messages from mobile to mobile without proceeding with the decoding of data. In that case, the receivers of the mobiles are to use a decoder that is capable of decoding the messages transmitted by the transmitters of their called parties. Therefore, the invention provides that the selection of a source coder in the transmitter of the transceiver automatically triggers the selection of a compatible decoder in the receiver.

Figure 3:
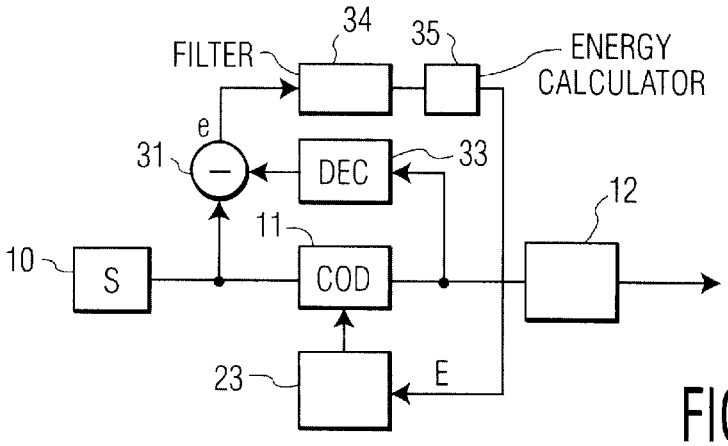
FIG. 3 illustrates a first embodiment of the transmitting part diagrammatically shown in FIG. 2.

FIG. 3 illustrates a first embodiment of the invention for estimating the distortion of the output signal of the source coder 11. According to this embodiment, in a subtraction circuit 31 a subtraction is made between the original speech signal S and the signal coded by the currently operating source coder 11 and then decoded by an inverse decoder 33 to obtain an error signal e that represents the error between the transmitted signal and the coded signal. This error e is then filtered by a perceptive filter 34 and an energy calculation block 35 calculates its energy. At the output of the calculation device 31+33+34+35 an estimate E is obtained of the distortion caused by the coder 11, which estimate will be processed by the check block 23.

Figure 4:
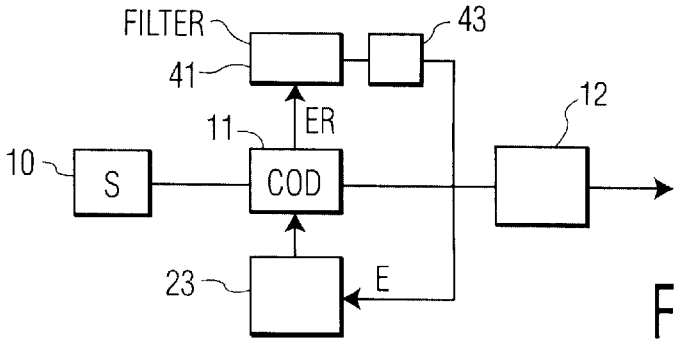
FIG. 4 illustrates a second embodiment of the transmitting part diagrammatically shown in FIG. 2.

FIG. 4 illustrates a second embodiment of the invention for estimating the distortion of the signal on the output of the source coder. According to this embodiment, the source coder 11 possesses an internal residual error ER which may be accessed to derive data therefrom. This residual error is then filtered by a perceptive filter 41 (this filter is already present in the transmission chain of radiotelephones in accordance with the GSM standard EFR 06.60). The energy of the filtered error is then calculated by an energy calculation device 43 to supply to the check block 23 an estimate E of the distortion of the signal caused by the source coder 11.

Figure 5:
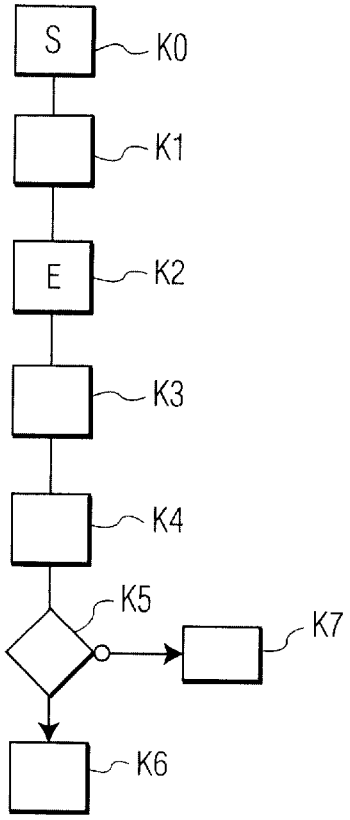
FIG. 5 is a flow chart illustrating a transmission process according to the invention.

A process according to the invention is illustrated in FIG. 5. It comprises the steps K0 to K7. The step K0 represents the reception of the speech signal S by the source coder. The signal S then undergoes a double coding step K1: a source coding intended to compress the transmit signal and a channel coding intended to protect the transmit signal against transmission errors. In step K2 an estimate E is made of the distortion caused in the original signal by the speech coder. This estimate E may be made, for example, according to one of the methods described with respect to FIGS. 3 and 4. The process is continued up to a check step that comprises a sub-step K3 of comparing the estimated distortion E with set values, followed by a decision sub-step K4 for choosing as a function of this estimate a coder from the coders present in the transmitter. The choice of the source coder having been made, the check block is to validate this choice via the radiotelephone network. Step K5 consists of making a request to the network to ask the network to replace the old coder with a selected coder and to wait for the response from the network. If the response is positive (K6), the coder selected previously replaces the old coder in the transmitter, if not (K7), the old coder is retained.

This process is preferably carried out once per data frame. But if the network or the receiver of the mobile of the called party does not leave the choice up to the decoder (for example, it has only a single decoder or the rate is unacceptable), the process will only be carried out once per connection or per communication.

Figure 6:
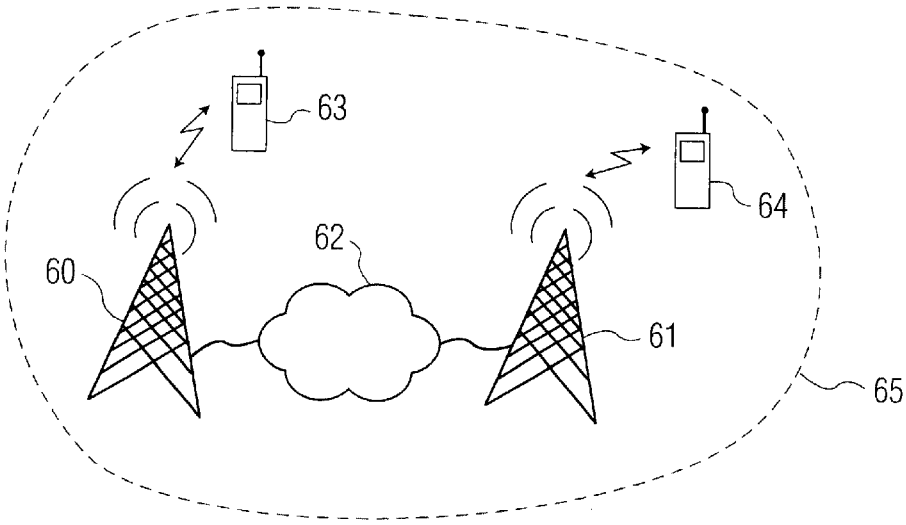
FIG. 6 represents an example of a digital communications system according to the invention.

FIG. 6 represents a cellular radiocommunications system, for example, of the GSM type. However, the invention may be implemented in all digital communications systems for which a source coding of the audio signal is made.

The system diagrammatically shown in FIG. 6 comprises two radio base stations 60, 61 connected to the GSM network 62, and also two mobiles 63 and 64 that may communicate with each other by radio channel inside a coverage area 65, representing the radio coverage area of the GSM network, via the base stations 60, 61 and the network 62. The stations 60, 61 realize the radio interface between the GSM network 62 and the mobiles 63 and 64.

In the current GSM standard, the network provides the decoding of the messages coded and transmitted by the transmitting mobiles before they are transmitted to the receiving mobiles. The source coder means situated in the mobiles will thus be compatible with the decoder means used by the network.

According to a particular embodiment, notably corresponding to the current GSM standard, the transmitting part of the mobile 63, after having selected a source coder as this has just been described, is to send a request to the network 60, 61, 62 to ask the network to adapt its decoder means to the source coder that has just been selected at the transmitting end. When a confirmation message is received, the transmitting part of the mobile 63 may thus effectively change coder.

However, for the case where the network would not effect the decoding of the messages coded by the mobiles, but would make do with transmitting them, another embodiment is provided.

In a connection between two mobiles, a transmitting mobile of a speech message, for example, the mobile 63, and a receiving mobile, for example, the mobile 64 are distinguished. According to the invention, the mobile 63 selects a source coder, but instead of asking the network for the authorization to use this source coder, it addresses a request to the mobile receiver 64 in the form of a signaling message via the network. For if the network does not decode the messages coded at the transmitting end, the task rests with the receiving mobile 64. Therefore, the receiving part of the receiving mobile 64 is to have means for selecting a decoder that is compatible with the source coder used at the transmitting end. These means comprise a plurality of decoders which are compatible with the source coders of the transmitting part and control means for automatically selecting, at the request of the transmitting mobile, a compatible decoder from the plurality of decoders.

To render the communication symmetrical between the two mobiles there is also provided that each mobile uses the same coder and the same decoder, but this is not mandatory. Actually, the communication may use one type of coding/decoding in one direction and another in the other direction. In order to homogenize the system, the invention provides that the receiving part of a mobile automatically selects a decoder that is compatible with the previously selected coder at the transmitting end. For this purpose, the receiving part comprises a plurality of decoders which are compatible with said source coders, and control means co-operating with the check means of the transmitting part for automatically selecting from the plurality of decoders a decoder that is compatible with the source coder selected at the transmitting end.

What is claimed is:

1. A digital signal transceiver, comprising a transmitting part and a receiving part, the transmitting part receiving at its input an original speech signal and delivering a compressed speech signal on its output, the transceiver comprising:

source coder means including a plurality of source coders for compressing said speech signal and delivering the compressed signal of only one source coder of said plurality of source coders at a time and at a given output rate, said compressed signal having a measurable distortion, and said one source coder being a currently operating source coder, calculation means for forming an estimate of the distortion of the compressed signal of the currently operating source coder, check means for comparing said estimate with set values and, dependent upon the result of such comparison, selecting one of the source coders for delivering the compressed signal.

2. A transceiver as claimed in claim 1, wherein the source coder delivers an internal residual error signal, characterized in that said calculation means use said error signal for estimating said distortion.

3. A transceiver as claimed in claim 1, characterized in that the calculation means comprise:

inverse source decoder means co-operating with the source coder means for producing a decoded signal based on said compressed signal, means for comparing the decoded signal with the original signal to produce a residual error signal, and means for processing the residual error signal to derive said estimate therefrom.

4. A transceiver as claimed in claim 1, the receiving part comprising a plurality of decoders compatible with said source coders, characterized in that the transceiver comprises control means co-operating with said check means for automatically selecting from the plurality of decoders a decoder that is compatible with the source coder selected by said check means.

5. Telephony equipment comprising a transceiver as claimed in claim 1, characterized in that it is in conformity with a digital telecommunications standard.

6. A digital telecommunications system for exchanging speech signals with telephony equipment as claimed in claim 5.

7. A transceiver as claimed in claim 1 wherein the check means comprise a memory which stores the set values, wherein each set value corresponds to a respective coder of said plurality of coders.

8. A transceiver as claimed in claim 1 wherein the source coder means delivers to the calculation means a single internal residual error signal corresponding to the distortion of the compressed signal of the single one of the source coders currently operative, and the calculation means use said single internal residual error signal to estimate the distortion of the compressed signal.

9. A transceiver as claimed in claim 1 wherein, in the selection means, each original signal undergoes only one source coding test for the selection of the optimum source coder of the plurality of source coders.

10. A transceiver as claimed in claim 1 wherein, if the distortion estimate is within predetermined acceptable values, the same one source coder is selected, and otherwise another source coder is selected corresponding to the distortion estimate as related to the set values.

11. A digital signal transmission process comprising the following steps:

a receiving step for receiving an original speech signal, a source coding step among a plurality of selectable coding steps, said source coding step being a currently operating step of compressing said original speech signal and at a given time delivering a compressed signal at a given output rate, said compressed signal having a measurable distortion, a selection step of selecting a source coder from a plurality of coders for realizing the source coding step, the selection step comprising:

a calculation sub-step for forming an estimate of the distortion of the currently compressed signal, and a check sub-step for comparing the estimate with set values and selecting the source coder as a function of the result of said comparison.

12. A process as claimed in claim 11, with the source coder delivering an internal residual error signal, characterized in that said residual error signal is used in the calculation sub-step for estimating the distortion of the compressed signal.

13. The process as claimed in claim 12 wherein, in the check sub-step, the distortion estimate is compared with set values stored in a digital memory, and wherein each set value corresponds to a respective coder of said plurality of coders.

14. A process as claimed in claim 11, characterized in that the calculation sub-step comprises:

an inverse decoding step for producing a decoded signal based on said compressed signal, a step of comparing the original speech signal with said decoded signal to obtain a residual error, and a step of processing the residual error to obtain said estimate.

15. A digital signal reception process comprising a source decoding step for decoding a compressed signal via a transmission method as claimed in claim 11, characterized in that the process comprises a step of the automatic selection of a decoder from a plurality of available decoders as a function of said selected source coder.

* * * * *